United States Patent [19]

Swanson

[11] 4,454,017

[45] Jun. 12, 1984

[54] PROCESS FOR RECOVERING HYDROCARBON AND OTHER VALUES FROM SHALE OIL ROCK

[76] Inventor: Rollan Swanson, c/o Chemroll Enterprises, Inc., 100 Wall St., New York, N.Y. 10005

[21] Appl. No.: 343,956

[22] Filed: Feb. 1, 1982

Related U.S. Application Data

[63] Continuation-in-part of Ser. No. 242,305, Mar. 20, 1981, which is a continuation-in-part of Ser. No. 220,021, Jan. 5, 1981, Pat. No. 4,366,044, and Ser. No. 140,604, Apr. 15, 1980, said Ser. No. 220,021, is a continuation-in-part of Ser. No. 114,207, Jan. 22, 1980, abandoned, and Ser. No. 63,824, Aug. 6, 1979, abandoned.

[51] Int. Cl.[3] ..... C10G 1/02; C10B 53/06

[52] U.S. Cl. ..... 208/11 R; 208/11 LE; 208/230

[58] Field of Search ..... 208/11 R, 11 LE, 230, 208/231, 232, 107, 108, 209, 213, 214, 208 R, 254 R

[56] References Cited

U.S. PATENT DOCUMENTS

| | | | |
|---|---|---|---|
| 3,387,941 | 6/1968 | Murphy et al. | 208/230 |
| 3,816,298 | 6/1974 | Aldridge | 208/264 |
| 3,948,754 | 4/1976 | McCollum et al. | 208/11 LE |
| 4,160,721 | 7/1979 | Swanson | 208/230 |
| 4,248,693 | 2/1981 | Swanson | 208/11 LE X |

FOREIGN PATENT DOCUMENTS

| | | | |
|---|---|---|---|
| 163519 | 5/1921 | United Kingdom | 208/11 |

*Primary Examiner*—Delbert E. Gantz
*Assistant Examiner*—Glenn A. Caldarola
*Attorney, Agent, or Firm*—Fred A. Keire

[57] ABSTRACT

An improved method for recovering hydrocarbon and other values from shale oil rock, whereby shale oil rock, during the reaction with a reagent and steam, is shattered to the extent that the hydrocarbon values and the unwanted pulverized gangue is collected such as via cyclones or a dust collector; the desired hydrocarbon values as volatile products may be recovered or further reacted in a separate reactor; a series of cyclones may be used to separate the dust from the hydrocarbon values; recoveries of over 90% of the hydrocarbon values and higher are achieved; as a further advantage, the collected dust may be used as an intermediate for making cement.

27 Claims, 1 Drawing Figure

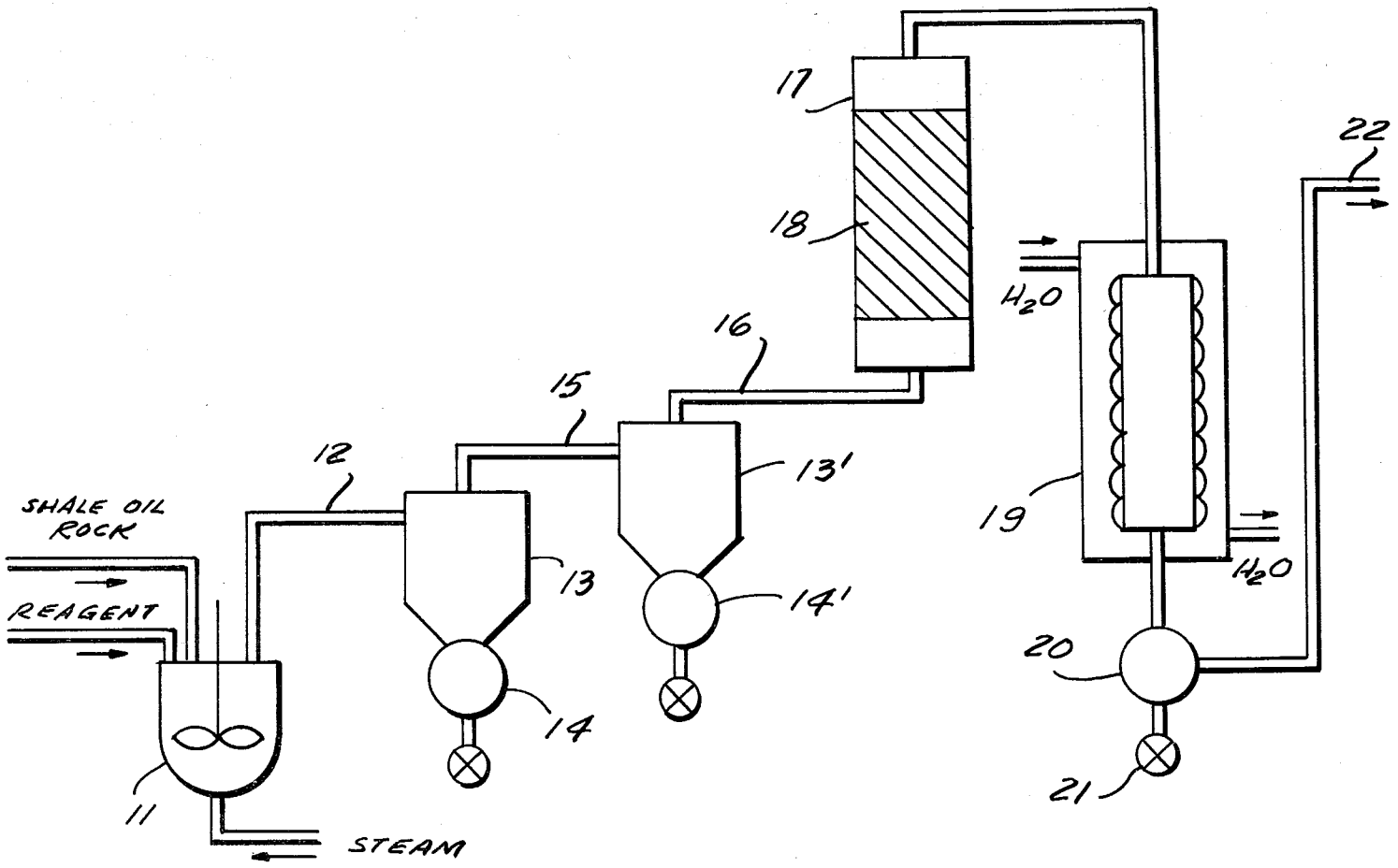
22
$H_2O$
$H_2O$
19
20
21
17
18
16
13'
14'
15
13
14
12
STEAM
SHALE OIL ROCK
REAGENT
11

PROCESS FOR RECOVERING HYDROCARBON AND OTHER VALUES FROM SHALE OIL ROCK

This application is a continuation-in-part application of Ser. No. 242,305 filed Mar. 20, 1981, which in turn is a continuation-in-part application of Ser. No. 140,604 filed Apr. 15, 1980 and Ser. No. 220,021 filed Jan. 5, 1981, now U.S. Pat. No. 4,366,044, issued Dec. 28, 1982; the last is a continuation-in-part of application Ser. No. 114,207 filed Jan. 22, 1980, now abandoned but refiled as a continuation application Ser. No. 268,190, now U.S. Pat. No. 4,366,045 issued Dec. 28, 1982 and application Ser. No. 63,824 filed Aug. 6, 1979, now abandoned.

This invention pertains to an improved method for recovering hydrocarbon, ammonia, and other metal values found in shale oil rock from a shale oil rock. More particularly, this invention pertains to a method whereby shale oil rock is reacted in a suitable reaction vessel, and during the reaction the part from which the hydrocarbon and other values have been recovered is shattered to such a degree that only hydrocarbon and the dust particles along therewith are removed from the reaction vessel. The unreacted part, including a suitable reagent therefor, stays in the reaction vessel.

In accordance with this invention, a complete conversion of all of the shale oil rock results in substantially only the reagent remaining in the reaction vessel. Hence, this process is equally applicable to a batch or continuous operation. Especially advantageous is the ability to collect, in a powder form, the unwanted part of the shale oil rock (gangue) and the relative ease of separation of hydrocarbon and other values therefrom, their optional further work-up, and the recovery of these hydrocarbon values. The unwanted gangue is in a form of a fine dust which is collected by means such as cyclones or centrifuge dust collectors. Further, the hydrocarbon values are in a form of gases and gaseous products which are sent on to further reactor(s) or are recovered immediately without further reaction, but are suitable for conventional processing in a manner well known in the art.

BACKGROUND OF THE INVENTION

It has become increasingly evident that the known hydrocarbon sources, such as petroleum, are being exhausted at a fairly rapid rate. While no prediction can be made when ultimately petroleum will be exhausted, it has become fairly evident that it will not be in the far future. Consequently, it has become important that other hydrocarbon sources be investigated for ready conversion of these into suitable products.

As one source, shale oil rock has received considerable attention. However, the problems associated with shale oil rock conversion are enormous. These are primarily the inability heretofore to recover the hydrocarbon values from the rock matrix in an economic and industrially acceptable manner. It has been the practice to mine and crush the shale oil rock and then to retort it. Retorting is extremely energy-wasteful. As much as 70% of the energy content of the shale oil rock hydrocarbon values is wasted in the retorting process. A net gain of the shale oil is thus only 30% of the total hydrocarbon values. Retorting also produces a great variety and large amounts of pollutants. Thereafter, the oil must be further processed with a further loss of energy to where the eventual product recovered is so expensive as not to be competitive, at the present time, with any of the known hydrocarbon sources.

With respect to the various methods for recovery of shale oil, a further method for leaving the shale oil in ground and retorting the same in situ has also been suggested. While the energy content recoverable thereby may be improved, the overall net gain is still far below the acceptable proportion so that the processes at the present time appear not to be commercially competitive with other hydrocarbon sources, such as from coal, tar sands, and the like.

PRIOR ART

As far as it is known to me, no method has been disclosed for recovering shale hydrocarbon values whereby the hydrocarbon values and the exhausted mineral values are removed together as a mixture of gas and dust from the unreacted portion of the shale oil rock. Moreover, no method is known to me whereby these two reaction products leave the unreacted starting material, yet are readily separated one from the other for easy recovery of each.

A number of prior art references are known concerning the various reagents which may be used for converting hydrocarbons. Of all of the prior art, that disclosed in the parent patent application Ser. No. 242,305 appears to be most relevant. However, in none of the recited references is there a disclosure found about the separation of the gangue dust with the hydrocarbon values from the unreacted portion of the shale oil rock and the subsequent separation of the two. Thus, the disclosed method in my prior application Ser. No. 242,305 has been further and significantly improved by the present process to where the process appears to be competitive with other methods for obtaining valuable hydrocarbon products. The art which pertains to the present invention is that disclosed in my prior application.

DISCUSSION OF THE PRESENT INVENTION AND EMBODIMENTS THEREOF

With respect to the process as it has been disclosed herein, it is aptly illustrated by reference to FIG. 1 wherein the reaction train for the hydrocarbon value recovery has been shown.

Referring now to FIG. 1, the reactor has been identified as 11. While the reactor is shown as a single vessel, a number of reactors feeding common product lines may also be employed. The reagent and the shale oil rock are introduced into the reactor prior to its being closed and purged. A purge gas, such as helium, nitrogen, or hydrogen is used. Thereafter, a suitable heating means, such as a coil (not shown), brings the reactor contents to a suitable temperature, and steam is introduced continuously at an appropriate rate. Steam is for supplying hydrogen for conversion of the hydrocarbon values to more hydrogenated species.

The reagent and shale oil rock may also be continually fed to the reactor by suitable devices, such as feed augers and metering pumps. Inasmuch as the reagent for present purposes has been found advantageously suitable when used in liquid form, at the reaction conditions, the reagent may be introduced at a level such that the contact with the shale oil rock is established all during the reaction. An appropriately designed stirring device, such as a spiral stirring device, is used with the reactor. Other stirring devices at slow rotational speeds, e.g. about 10 rpm and less, or the rotation of the reactor rotating at less than 10 rpm, such as akin to a cement-making kiln, may also be employed. The reactants leave the reactor via a riser 12. A suitably sized riser is in a form of a pipe or cylinder and is being kept heated so that the hydrocarbon values do not readsorb or reabsorb to or in the fine dust particles. A dust riser may be of a height such that the particles which may not have completely reacted but are being shattered during the reaction may still fall down and are again brought into contact with the reagent and steam.

It may be necessary to vary somewhat the diameter of the dust riser as well as the length thereof with different shale oils, but the length and size is established as the best size which can be used in combination with the cyclones 13.

The dust is first separated to the extent possible in the first cyclone 13 and falls into a collector 14 at the bottom thereof. Again, the cyclones are of a size and dimension suitable to accomodate the volumetric flow of the dust and gases and may be sized in accordance with well-known engineering principles. It is desirable to avoid liquid phase occurrence in these cyclones. These cyclones (which have been identified with the same numbers for the sake of convenience) are, therefore, being kept heated, i.e. at the reaction temperature of the reactor or even higher, e.g. up to 10° to 25° C. and higher, and thus again assure the separation of the hydrocarbon values from the shale oil rock and the dust particles thereof. Similarly, the collection vessels 14 are suitably heated or the dust is removed immediately so as not to expose the pulverulent gangue, as it cools, to the hot hydrocarbon gases.

In any event, the shattered rock dust particles are so fine that a series of cyclones may be needed for complete separation. Hence, for purposes of illustration, two have been shown. Similarly, two collection vessels have been shown, but as mentioned before, the collection of the dust may take place as the dust accumulates, but in a continuous manner.

Furthermore, between the first and the second cyclone a suitable pump (not shown) may be installed which increases the flow of the remaining dust and gas and thus allows the sizings of the second cyclone to meet the demand. Instead of the illustrated cyclones which have been found to work suitably for the present purposes, other separating means may be used in combination with a cyclone(s). These are such as hot gas centrifuges and the like which, being kept hot, allow a continuous removal of the fine dust particles. A suitable centrifuge (not shown) may be used together with a cyclone(s) and be installed in the line designated as 15 which would remove the remaining dust particles. It is believed, however, that the cyclones may be sufficient to separate the dust particles, based on present experience.

As presently run, the process has been highly successful employing two cyclone separation, although the process is not intended to be restricted to this means of separation of the dust from the hot hydrocarbon values. In any event, the entire hydrocarbon-dust reaction train should be kept at the reactor temperature conditions or higher so that the reabsorption or readsorption of the hydrocarbon values to the shattered, pulverulent rock gangue do not readily take place. The cyclone(s) 13 may also be run at subatmospheric pressures if the entire reaction train (or even a partial reaction train ending with the cyclone(s) is under vacuum conditions.

After the dust separation, the hydrocarbon values may be recovered directly and further processed in a conventional manner. Separation means such as condensers or suitable distillation columns may be employed. These separation means are well known in the art and need not be discussed in greater detail.

However, it has been found extremely advantageously that while the hot hydrocarbon gases are being recovered, a further reactor(s) 17, shown in FIG. 1 herein, be employed. It is very helpful for efficient and further upgrading of the hydrocarbon values that these be reacted to obtain the desired degree of hydrogenation or reformation from the spectrum of products recovered from the shattered shale oil rock. Further sulfur and nitrogen removal may also be accomplished thereby.

The reactor 17 contains therein a suitable reagent or a mixture of reagents which will be further described herein, conveniently in a supported form. While the reagent may be held on bubble trays or some other contact means and the hydrocarbon gases pass therethrough, it has been found that the reagent, as supported on a suitable alumina-alumina silicate support, as further described herein, is especially advantageous for further upgrading of the hydrocarbon values. Although the first reaction in the reaction vessel 11 will produce hydrocarbons of an API value from about 15 to 31, the reagent in the second reactor will upgrade and produce, by further hydrogenation, hydrocarbons in the API range from 26 to 58 (depending, of course, on the API for the hydrocarbon value from the first reactor).

These hydrocarbons can then be suitably employed for further finishing, separation, treatment, etc. in a manner well known in the art.

If a reactor 17 is employed containing a suspended catalyst, i.e. such as in a fluidized bed or a fixed bed, as illustrated by the schematic presentation 18, the hydrocarbon vapors are then recovered by a means such as a series of condensers, one of which is shown as 19 with a collection vessel 20 and a suitable removal port therefor 21. The hydrocarbon gases which are not condensed in the condenser and are not further reformed in another reactor (not shown) are then recovered from the condenser as gases. These hydrocarbon gases are the lighter ends and can be employed for variously desired purposes.

Based on the reagent selected, the product obtained may range from about 92% to about 25% of hydrocarbon values in the form of liquid condensates, and from about 8% to 75% of hydrocarbon values in the form of gases, on a weight basis (based on Fisher assay of the kerogen content). The carbon dioxide produced during the reaction is not counted into the above range. However, these proportions may be readily changed based on the severity of hydrogenation desired and/or reformation (subsequent dehydrogenation) selected. Thus, if more than one reactor is desired, the hydrocarbon gases coming over the line 22 may be further reformed by dehydrogenation and suitable formation of larger molecules may be accomplished. Further upgrading may be carried out by employing present-day technology. However, the fact that the presently employed reagent is not substantially affected by the typical catalyst poisons, such as metals in these hydrocarbons, it is attractive to employ the herein described reagents in reactor 17.

Inasmuch as the composition of the reagent 18 may be varied to accomplish different degrees of hydrogenation, a number of upgrading combinations are possible in conjunction with the obtaining of the hydrocarbon values. Thus these may range from substantially liquid distillates to substantially gaseous distillates depending on the degree of hydrogenation or reformation of various materials. These variations will be further illustrated herein.

It is, however, stressed again that, in general, the upgrading of the hydrocarbon values by means of the present reagents is a more advantageous method of upgrading as these reagents are not influenced by contaminants in the form of metal constituents commonly found in shale oil rock. In fact, the supported reagent, while it builds up these metals gradually, loses its activity only gradually. This also allows recovery of the desirable metals from the shale oil rock when regenerating the supported reagent primarily from the reagent in reactor 11.

Moreover, the recovery and/or utilization of other values in the shale oil rock, such as ammonia and sulfur, can be readily accomplished by means of the present process, and thus the present process offers a greater number of advantages when compared to the commonly known technology. With respect to the nitrogen values, these are recovered as ammonia or soluble amines and are worked up in a conventional manner.

Shale oil rock, as it is well known, contains considerable amounts of oxygen, nitrogen and sulfur. Nitrogen is especially deleterious, because when shale oil rock is recovered by conventional retorting technology, nitrogen values are not readily separated therefrom and cause rapid deterioration of the oil. Nitrogen, however, according to the present invention, can be readily separated from the shale oil rock, either in the reaction 11, or after the reactor(s) 17, and the reaction products of the various nitrogen-containing hydrocarbon species are insignificantly deleterious, e.g. as to product stability.

With respect to the sulfur compounds, again shale oil rock contains a considerable amount of sulfur, up to 10% but more typically from 1 to 5%, and sulfur is readily separated from the products. Sulfur may be removed to a substantial degree based on the sulfur as found in the original rock and the condensate such as recovered via port 21. If appropriate reagents are selected, the reaction can be run exothermically, which may be in part due to the high sulfur content in the shale oil rock. It appears that increasing amounts of sulfur in shale oil rock promote the exothermic reaction and may cause an otherwise non-exothermic reagent to become exothermic.

The dust collected (in cyclones 13 and the collection vessels therefor 14) is a light gray to white, very high surface area dust similar in characteristics to very fine cement. As an example, a run of a Western U.S. shale oil rock gave about 1300 cc dust/for about 80 cc of oil, and 75% of noncondensed gas. When essentially vaporous normally liquid hydrocarbons were was produced, about 1300 cc dust/to about 250 cc of oil was obtained. This dust may serve as a starting material or an intermediate for cement production, either by supplementation or augmentation of necessary components or, depending on the shale oil rock constituents, as a low grade cement. The great savings achieved by not requiring extensive firing which is encountered with typical cement-making operations makes it readily apparent that the collected materials can serve a very useful purpose for making the present process that much more desirable. If the process is run correctly and the dust is kept hot and the hydrocarbon separated, the dust shows no visible signs of carbon oxidation when exposed to a flame.

Preliminary tests with these fine dust particles have shown that the dust may set up in a cementatious-like reaction. Although these preliminary tests are clearly indicative of the usefulness of the process, the end use applications are manifold for the shale oil rock dust gangue. According to present-day technology and using present-day processes, shale oil rock gangue constitutes one of the most unwanted and undesirable by-products. Inasmuch as the present-day shale oil rock technology has created a number of undesirable pollution consequences, the present process appears to be especially advantageous.

Moreover, when it is considered that only from 5 to at most 60% of the shale oil rock is in the form of hydrocarbon values, the enormity of the disposal problem should become fairly evident. Therefore, it is especially noteworthy that the present process is not only able to recover the shattered shale oil rock powder or dust residue in a convenient form, but also provides this rock residue as a suitable starting material for a number of other uses completely unforeseen and as a side benefit to the present process.

The fact that the shale oil rock residue is in a form of a fine dust particle is especially beneficial, because tremendous energy is required to obtain fine dust particles. According to the present process, the obtention of these fine dust particles is a consequence of the process and the reaction taking place in the reactor, and thus no energy waste is encountered. When it is considered that the recovery of the hydrocarbon values is over 90%, as based on the organic hydrocarbon values in the shale oil rock (e.g. 100% from Israel shale oil rock and Western U.S. shale oil rock by Fisher assay of kerogens), and has been over 100% when inorganic carbon converted to hydrocarbon values are included in the recovered organic hydrocarbon values, it is clearly an outstanding achievement heretofore completely unknown and unforeseen in the shale oil rock treatment art.

In the following discussion, the various process variables will be discussed in greater detail. This discussion is introduced for ready understanding of the present process and serves to illustrate the considerations which must be taken into account when practicing the present process.

The introduced shale oil rock may be in a comminuted form, the particles being of a size from ¼" to ⅜". Inasmuch as the reaction is size-independent, except that very fine dust size particles are not desirable, as these are lifted during the reaction along with the gangue dust, the process can be readily practiced with any size of rock which is suitable for the reaction vessel. For larger vessels, of course, larger size rocks may be used.

Water is introduced in the form of water or steam and typically the reaction would start at a temperature of 50° C. and higher up to 560° C.; it is desirably conducted at a temperature of 450° C. and lower. Depending on the reagent selected, temperatures in the reactor, however, can be at the following intervals: about 200° to 440° C.; about 200° to 280° C.; about 280° to 320° C., and about 320° to 440° C. Hence, water in the form of steam or convertible to steam in situ is introduced in the reactor. Conveniently, water in the form of steam is introduced at the bottom of the reaction vessel. A reagent, such as potassium hydrosulfide or sodium hydrosulfide (technical flakes), as starting reagents, are liquids at the reaction temperatures (due to some decomposition and bringing the reactants to process conditions), and thus will descend downwardly in a batch reaction with the degree of completion of the reaction to where, when the shale oil rock is completely reacted, only the reagent is at the bottom of the reaction vessel. Certain compositions of the reagent tend to deposit on the sides of the reactor, but may be removed with a scraper-stirrer or are kept in contact with the shale oil rock by constant addition of same to the level where the reagent is deposited.

The amount of steam introduced is in proportion to the hydrocarbon values in the shale oil rock. Steam is introduced in an amount ideally 27%, by weight, but 50%, by weight, of the kerogen content in rock, is a practical lower limit. An excess of steam gives greater dust separation capability. Hence, the upper limit is only determined by the amount of steam which would not impair the reagent function in the reactor(s) 17.

However, the amount of steam should not exceed 1 mole of water/minute/2/3 mole of supported catalyst in the reactor(s) 17 if a reactor(s) is used. If each carbon atom in the shale oil rock were completely hydrogenated (the most severe hydrogenation), it would represent a methane gas. The amount of hydrogen needed for complete hydrogenation thus would be the largest amount. Conversely, if the product sought to be obtained is a distillate with little or no hydrogenation, then the amount of steam introduced is less, depending on how much dust is being lifted from reactor 11. However, it has been found best that between these two limits, steam is used in an amount necessary to furnish the desired hydrocarbon cut or gaseous hydrocarbon values which are sought and desired for the particular run, but without any substantial excess. Inasmuch as steam furnishes the hydrogen values added to the shale oil rock hydrocarbons upon hydrogenation, steam is thus directly proportional to the degree of hydrogenation sought. However, inasmuch as the amount of hydrocarbon values varies over a considerable range, not only for the same type of shale oil rock but also from type to type of shale oil rock, the amount of steam introduced can best be expressed functionally as that necessary to obtain the desired hydrocarbon values. Supplemental steam may also be introduced in reactor(s) 17; for most purposes it is adequately carried over from reactor 11.

The process is best run, because of various cost considerations, at atmospheric pressure. However, the process can equally well be run at subatmospheric pressures and up to about 10 atm. For example, exothermic reactions run best a lower pressures, such as as low as 50 to 60 mm of Hg, although these can also be adequately run at atmospheric pressure. Higher and lower pressures, of course, make the process more complicated. Nevertheless, these possibilities exist, and for this reason a more suitable variation in the pressure would be from subatmospheric, e.g. about ½ atm. to about 5 atm., but as mentioned before, the preferred pressure is atmospheric pressure.

The reagent is typically used in an amount from 3 grams to 35 grams per 100 grams of the shale oil rock as start-up amount for KHS. For NaHS (technical flakes), it is about 8% by volume based on rock (rock is about 1 gr/cc in ¼ in. size); this amount may be increased by at least 50%. Typically when using $K_2S_x$ (empirical where x is 1 to 3) the amount of this reagent is ⅔ gram mole and this amount is used per 3000 gr of rock; however, the amount may be decreased by 75% or increased as needed (without affecting the reagent in reactor(s) 17 due to greater amounts of steam needed when increasing the reagent). The reaction rate may be influenced by the amount of reagent which can be brought in contact with rock and steam. The above amounts are start up amounts or batch amounts, but a continuous reaction may be run merely by adding rock and periodically augmenting the reagent if needed.

As mentioned before, in shale oil rock, carbon is also converted to hydrocarbon values by the hydrogenation of some of the inorganic carbon components of shale oil rock. The various proportions of organic and inorganic carbon values in shale oil rock are given in the prior art, such as in the book authored by T. F. Yen et al., *Oil Shale*, Elsevier Publishing Company, New York, NY, 1976, and T. F. Yen, *Science and Technology of Oil Shale*, Ann Arbor Science Publishers, Inc., Ann Arbor, Mich., 1976. The disclosure of the various shale oil rock compositions and the analyses thereof are incorporated by reference herein.

Based on the above description and in distinction from tar sands, shale rock contains on an average from about 5% and less, by weight, to about 60% by weight and higher of kerogens and bitumens associated with a number of other components, such as iron (in various forms of iron salts), calcium salts, for example, calcium carbonates, magnesium salts, such as magnesium sulfates or carbonates, etc. As it is evident from the above references, the carbonate portion of the rock matrix also participates, apparently, in the reaction because of the very high yields which are obtainable when practicing the present invention.

In addition to the above disclosure and as referred to in FIG. 1, the reagent may be optionally augmented with hydrogen sulfide co-fed with steam during the reaction. This aspect of the invention appears to be desirable when the stability of the reagent is sought to be maintained as influenced by the various forms of iron or other reactants which may be attacked by the reagent. For this reason, the hydrogen sulfide addition is conveniently on a space/time/velocity basis and ranges from 40 to 120 ml/min/gal of reactor space or about 10 ml/min/liter to about 30 ml/min/liter of reactor space. An addition of about 20 ml/min/liter is typical. On the same basis, but (calculated) as another option, sulfur in elemental form may also be added when the reaction temperature is below 440° C.

The reasons for hydrogen sulfide or sulfur addition follow from the illustrated reactions:

1. the hot water hydrolysis-decomposition of polysulfides as illustrated by $K_2S_2$ is as follows $$4K_2S_2+8H_2O \rightarrow 4KOH+4KHS+4S+4H_2O;$$

$$4KOH+4H_2S \rightarrow 4KHS+4H_2O; \qquad 2.$$

3. when shale oil derived sulfur is present, then $$4S+6KOH \rightarrow K_2S_2O_3+2K_2S+3H_2O;$$

4. in turn $$K_2S_2O_3+3H_2S \rightarrow K_2S_5+3H_2O.$$

Hence, if $H_2S$ is present, KOH is converted to KHS and if any KOH forms the thiosulfate, then the thiosulfate is converted to $K_2S_5$. Inasmuch as KOH attacks, e.g. iron salts in the gangue, the apparently preferential, or at least favorably competing, reaction with hydrogen sulfide minimizes the side reactions and makes the process attractive.

Further reactions are as follows:

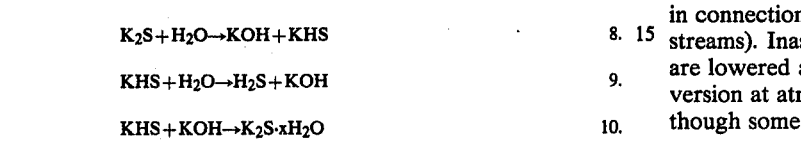

$K_2S_5 \rightarrow K_2S_4 + S$ (above 300° C.) 5.

$K_2S_4 \rightarrow K_2S_3 + S$ (above 460° C.) 6.

$KHS + K_2S + 3H_2O \rightarrow 3KOH + 2H_2S$ 7.

$K_2S + H_2O \rightarrow KOH + KHS$ 8.

$KHS + H_2O \rightarrow H_2S + KOH$ 9.

$KHS + KOH \rightarrow K_2S \cdot xH_2O$ 10.

(x can be, e.g., 2, 5, etc., depending on temperature). Hence, enough $H_2S$ should be present to keep the reactions, by mass action, in a state, where the reagent is stable, i.e., sulfur is taken up either when freed from shale oil or shale oil rock or from the reagent, and hydrogen sulfide keeps the reagent from loosing $H_2S$ from reagent due to its hydrolyzing and minimizes free potassium hydroxide formation. Moreover, the thiosulfate generated by water or the oxygen present in shale oil rock is regenerated during the reaction to the desired $K_2S_5$. Thus, the reagent is kept in the desired stable state by $H_2S$.

Of the various reagents, the following are useful because of stability and/or sulfur acquisition ability, KHS, NaHS, $K_2S$, $K_2S_2$, $K_2S_3$; and of these, the order of preference is as follows: NaHS (because of price and availability); KHS, $K_2S_2$, $K_2S$ and then $K_2S_3$ (these include the empirical potassium to sulfur overall ratios). The other sulfides display instability at their melting points, e.g., $Na_2S_2$ at 445° C., $Na_2S_4$ at 275° C.; or give off sulfur at 760 mm, e.g., $K_2S_5$ at 300° C. yields $K_2S_4 + S$; $K_2S_4$ at 460° C. yields $K_2S_3 + S$; and $K_2S_3$ yields $K_2S_2 + S$ at 780° C. Melting points of the alkali sulfides illustrated above are as follows: for $K_2S$ at 948° C.; $K_2S_2$ at 470° C.; $K_2S_3$ at 279° C. (solidification point); $K_2S_4$ at 145° C.; $K_2S_5$ at 206° C.; $K_2S_6$ at 190° C. Melting points for mixtures of the sulfides (pure or eutectic mixtures) are as follows: for $K_2S$-$K_2S_2$ it is 350° C.; for $K_2S_2$-$K_2S_3$ it is 225° C.; for $K_2S_3$-$K_2S_4$ it is about 110° C.; for $K_2S_4$-$K_2S_5$ it is 183° C. As prepared, these are hydrates of all of the foregoing and these are included in the recitation of the reagent as charged to the reactor. Each of the alkali metal hydrosulfides and mono- and polysulfides have one or more than one hydrate. Unless otherwise noted, the term hydrate is meant to include all the hydrates which may be formed or the eutectic mixtures of each. Similarly, all of the mixtures which may be employed under the reaction conditions as these are transformed from one form to another, i.e. either the empirical sulfides or hydrates and intermediates, such as thionates, thiosulfates, etc., and including like oxygen-sulfur-alkali metal compounds and complexes, or complexes formed in situ during the preparation and use of these (e.g. alcohol complexes), are within the scope and contemplation of this invention. Based on the various illustrations above, appropriate temperature-stability conditions are selected as dictated by decomposition and/or melting point characteristics so as to allow the use of a solid reagent, or a stable liquid reagent. Of course, the various hydrates of the alkali sulfides have various melting and/or decomposition points which also hold true for the eutectic mixtures of these hydrates. These temperature points may be readily established thermographically, as it is well known to those skilled in the art. Hence, these hydrates may be transformed or be eliminated during the reaction conditions depending on the temperatures. In describing the various sulfides and their decomposition temperatures, including the reactions, my U.S. Pat. No. 4,210,526 issued July 1, 1980 is relevant.

At peak operating temperature e.g., 400° C. to 560° C., $K_2S_5$ will yield sulfur (which is a useful phenomenon in connection with dehydrogenation of further process streams). Inasmuch as the decomposition temperatures are lowered at lower pressures, the shale oil rock conversion at atmospheric pressure is entirely feasible. Although some benefit is gained by operating at elevated pressures, e.g. above 5 atm., the added cost and other expenditures make this merely a less desired method of operating the shale oil rock conversion process.

As a practical matter, the amount of KHS per thousand grams of rock added is established by a series of runs for the particular type of shale oil rock being used, with progressively lower amounts being used such that the eventual optimum amount is established based on the above prescription. Thereafter a series of runs may be made with hydrogen sulfide addition. This is desirable, because the shale oil rock contains carbon in the various forms thereof, such as the organic carbon from kerogens, the inorganic carbon from the various carbonates, free carbon, and bitumen admixed with the shale oil rock kerogen. For this reason, a slight excess of reagent of that believed necessary for conversion within the above-indicated ranges is often suggested to accomodate the various and competing reactions. Needless to say, inasmuch as the composition of the shale oil rock is extremely complex, very precise prescription is not possible and a certain amount of excess is properly indicated whenever necessary to accomodate the various changes in the shale oil rock composition.

It should be understood that there are many competing reactions and the alkali metal sulfide chemistry is very complex. While every attempt has been made to explain the process as it is understood, the basic criterion has been the workability of the process as applied to shale oil rock, the shattering of this rock by the reagent and the preferential separation of the shattered (pulverulent) rock with the gaseous and vaporous hydrocarbon values from the starting material shale oil rock. This result has been achieved consistently and is further demonstrated herein such as by the examples.

As mentioned before, the reaction conditions are such that while the reaction starts at a temperature from 50° C., by primarily expelling ammonia, the continuous reaction is best conducted at a set chosen temperature level. These temperature levels typically would range from 200° C. to about 560° C., as given above, but it has been found that the reaction runs at even higher temperatures, but at a disadvantage. This disadvantage results from the instability of the product, the control of the reaction, and the less desired product mixture obtained.

However, the temperatures at which the reaction begins are as low 50° C. and may go up to 130° to 170° C. before any substantial amounts of reaction product are obtained. However, during this period some reaction does take place. For purposes of rate considerations, the rates at which the product is being reacted, and commercial practices, it is believed that the best temperature ranges are from about 200° C. to about 440° C. at various set temperature limits chosen to conduct the reaction in a continuous process.

As it will be further illustrated by the examples herein, certain of the reagents will cause the reaction to be exothermic. As a result, more heat will be produced than is necessary for the reaction. The reaction can then be moderated by the amount of steam (or water) being introduced. If excessive steam is introduced, the reaction can then be slowed by the reagent becoming less reactive (the previously discussed caveats, however, should be noted). Conversely, if no steam is introduced, the reaction can be stopped, although in any event the reaction has a certain inertia and the temperature may still rise above the desired temperature. These reactions, of course, are very complicated, and hence it is best to conduct the reaction for each shale oil rock type at its best temperature as found by experiment. As the reagent is air oxygen decomposition prone, a reagent is best used by excluding oxygen therefrom. It is best that the reagent is introduced in the process equipment, e.g. the reactors, after the entire reaction train is sparged with an inert gas such as nitrogen or preferably helium. Hydrogen may likewise be used.

In the following examples appropriate shale oil extraction runs are shown. Various reagents are illustrated to show the various aspects of the invention. These examples are merely illustrations and are not intended to limit the scope of the invention. When indicating the various compositions, the percents are by weight unless other basis has been indicated.

EXAMPLE I

Two runs were made with shale oil rock found in Israel. Insufficient oil was obtained from a single run to give a distillation range. The two runs were combined to make sufficient oil for the distillation range.

Run No. 1

About 60 ml of the below described reagent solution was reacted with 1900 grams of shale oil rock by merely admixing the rock and reagent solution. A two layer reagent was used of the following composition. To 6 moles of KOH dissolved in 12 moles of water is added 108 ml absolute EtOH plus moles 4 S dissolved therein. When this solution is made (the exothermic reaction of dissolving KOH in water supplied the necessary heat), a further 2 moles of S in 108 ml of absolute EtOH were added to make an empirical $K_2S_2O_3+2K_2S_2+3H_2O$. This reagent forms a two layer solution. ⅓ of the solution with the amounts of the solution taken in the ratios in which the two layers are to each other, are added to an equimolar amount (on basis of K), of a reagent made as follows, i.e. $KOH+2H_2O$, with the solution saturated at cold conditions with $H_2S$; another mole of KOH is then dissolved in this solution. The solution melts at 60° C. The reagent is then $K_2S.5H_2O$.

The rock was treated in the reactor with mechanical agitation, steam and $H_2S$ @ 80 ml/minute/gal. The shale oil rock was from Israel.

The reaction proceeded well, but at 320° C. (approximately) the reaction became exothermic and rose to 440° C. The heat had been turned off at 320° C. but the exothermic reaction had begun below 320° C. Steam was stopped at 380° C. but the exothermic reaction proceeded until a peak temperature of 440° C. was observed. There were 59 liters of gas produced. Hydrogen made up 69% of the gas, by volume, $CO_2$ made up 6%, by volume (principally derived from the carbonates of the shale rock), the remainder was hydrocarbon with a carbon content between 1 and 6. 77 ml of condensate was obtained having an API of 29 and a sulfur content of 7.1%.

Run No. 2

About 60 ml of solution of the following reagent was mixed with 2200 grams of Israel shale oil rock. The reagent was as described in Run No. 1 except that $KOH+2H_2O$ was saturated at cold conditions with $H_2S$, a further addition of one mole of KOH was made and a solution obtained. The solution was heated above 180° C., then 0.83 moles of sulfur was reacted with this solution. The other catalyst was the same as the above Run No. 1, except that no further sulfur was added (vis-a-vis the two moles previously added). Equal amounts of solutions on K basis, were added. The reactor for this, as well as the previous run, was a round steel reactor of about one gallon capacity and heated and stirred mechanically. The oil distilled from the rock principally at 220°–240° C. and at 280°–320° C., in the presence of steam and hydrogen sulfide, the last at 80 ml/minute/gal.

The Israel shale oil rock contains 5% hydrocarbon ±25% (of the 5%) by weight. The sulfur content of the rock is 2.5% by weight.

The hydrocarbon condensate contained 6.25% sulfur by weight, had an API of 31 and the collected liquid volume was about 71 ml. There was an uncondensed distillate consisting of 37 liters of gas which contained 66% hydrogen by volume, 2% carbon dioxide by volume, 1% carbon monoxide by volume, and 28% hydrocarbon by volume which had carbon contents between 1 and 6. Part of the condensate was lost when an excess steam surge blew some of the rock into the condensation vessel.

The distillates from the two runs were combined and 100 ml was subjected to a boiling point determination. The boiling point range determination showed an initial boiling point (160° F.) and the end point of 585° F. with a 1.7% (by weight) residue. The 1.7% residue contained 3.7% sulfur. The sulfur content of the 0–50% boiling point range product was 7.25%, the sulfur content of the 50% to end point product was 4.1%. Thus, the sulfur content of the Israel shale oil extracted from the rock, according to this invention, is greatest in the lower boiling point fraction. The nitrogen content was reduced to 0.11%. The product was a greenish brown and was clear.

As shown above, a milder reagent, which will cause an exothermic reaction at a higher temperature, e.g. 360° C., was obtained by combining $K_2S_2.XH_2O$ (obtained by heating $K_2S.2H_2O$ at 100° C. in presence of sulfur) with a two layer reagent prepared as above, except that no additional two moles of sulfur were introduced. Again, equimolar amounts of the two reagents were used, based on the amount of potassium (on elemental basis). From the two layer reagent described above, the solution was taken in the ratios in which the two layers are to each other.

As it is evident from this example, mixtures of sulfides of the alkali series may be used, as well as mixtures of the sulfides of the alkali species such as potassium.

EXAMPLE II 453 grams of the shale oil rock, as in example I, were reacted with potassium hydrosulfide, KHS, in hydrate form, and in the presence of water. The amount of reagent used was 60 ml of solution of 0.4 gr/ml of KHS. The potassium hydrosulfide used was an alkanoic solution (methanol or ethanol) of the potassium hydrosulfide and was removed by elevating the temperature to about 135° C. At that time some of the hydrosulfide had formed a potassium sulfide hydrate $K_2S.xH_2O$ (x is typically 5 at those conditions). Some of the reaction product, which was collected in two condensers in series, was carried over with the distillate. At about 160° C. the potassium sulfide hydrate decomposed giving off copious amounts of gas.

Substantial amounts of liquid hydrocarbon condensate from the rock were obtained at between 230 to 250° C., again at 320° to 350° C. and at 370° C., and finally at a peak temperature of 400° C. However, at the end of the run at 400° C., there was little condensate. No provisions were made for collecting gases. A total of 25 ml of oil product of a specific gravity of 0.89 and an API Number of 26 were collected as a condensate. Inasmuch as this shale oil rock sample was believed to contain 5% hydrocarbon by weight, the recovery was almost complete, i.e., about 98.2%.

EXAMPLE III

Four hundred thirty five grams of the same shale oil rock was run with NaHS flakes (technical grade). The amount of reagent was 100 gr. These flakes melt at 112° C. The melt state is extended by use of inert atmosphere and in presence of water vapor.

The hydrate melting at 112° C. decomposes at a higher temperature with accompanying liberation of water into a lower hydrate which is a solid. Water was introduced into the reactor at rate of about 6 ml/minute/gal. During the run described in Example II, as well as in this example, no hydrogen sulfide was added. 24.5 ml of the product was obtained in the same manner as in Example II, and this condensate also had a specific gravity of 0.89 and an API (American Petroleum Institute) number of 26. A second run also gave a product with an API number of 26.

A water wash of the rock gave a green color solution, in fact, a very deep green. This signified the presence of alkaline iron species including other mineral complexes.

When hydrogen sulfide was used, the formation of these complexes (presumably ferrite-ferrate complexes), was reduced considerably and so was reagent consumption.

From the above examples, it is evident that there is no appreciable difference between the quality and quantity of the hydrocarbon product obtained when sodium hydrosulfide (technical grade in flake form) was used with the dripping of water into the reaction vessel and when alkanolic solutions of potassium hydrosulfide and steam were used as the reagents in the process.

However, in later runs it was found that appreciably smaller amounts of reagent could be used when hydrogen sulfide was used in the reaction vessel (thereby improving the economics of the process).

Based on the above illustrations, when practicing a single stage reaction, the API number (at 60° F.) for the condensate may range such as between about 20 to 32 with the range of about 25 to 30 fairly achievable, with the yields of the product being about 100% and higher, based on the amount of organic carbon present in shale oil rock. For these results to be obtained, hydrogen sulfide presence is highly desired.

For a two stage reaction, with supported catalysts, the API numbers may range in the 40's and higher.

EXAMPLE IV 466 grams of shale oil of the type given in Example I was treated with 18.6 grams of reagent in a first reaction vessel and with 12.4 grams of reagent in a second reaction vessel.

The reagents were as follows: KHS and $K_2S.xH_2O$ in the first reaction vessel as well as the second.

The reaction in the second reaction vessl was in a gas phase with a supported reagent. The temperatures were in first reaction vessel 390° C. peak; in second reaction vessel 220° C. Thus, this Example is an illustration of a reaction that is similar as to that depicted in FIG. 1. This example, however, illustrates a two reactors combination akin to that in reactor 11 and reactor 17. Further illustration of this embodiment will be shown herein.

Analysis of the initial distillate from the second vessel was as follows:

| | |
|---|---|
| Degrees API @ 60° F. | 22.6 |
| Specific Gravity @ 60° F. | 0.9180 |
| Sulfur % | 5.94 |
| BTU per pound | 17411 |
| BTU Per gallon | 133125 |
| Ash | 0.008 |
| Carbon | 80.48 |
| Hydrogen | 10.66 |
| Sulfur | 5.94 |
| Nitrogen | 1.05 |
| Oxygen | 1.86 |
| Sodium | 0.32 ppm |
| Vanadium | N/D |
| Potassium | N/D |
| Iron | N/D |

Analysis of the final distillation faction:

| | |
|---|---|
| Degrees API @ 60° F. | 19.5 |
| Specific Gravity @ 60° F. | 0.9371 |
| Sulfur % | 6.19 |
| BTU per pound | 17571 |
| BTU Per gallon | 137124 |
| NET BTU | 16470 |
| Viscosity @ 100° F. | 41.9 SSU |
| Ash | 0.007 |
| Carbon | 80.51 |
| Hydrogen | 12.04 |
| Sulfur | 6.19 |
| Nitrogen | 0.96 |
| Oxygen | 0.29 |
| Sodium | 0.42 ppm |
| Vanadium | N/D |
| Potassium | N/D |
| Iron | N/D |
| Nickel | N/D |

It is noted that while the API number decreased (as it should for the last distillates), the hydrogen content, nevertheless was increased. The above reactions were without the benefit of hydrogen sulfide addition. Addition of hydrogen sulfide does increase the product quality.

In subsequent runs, it was found that decreasing the amount of reagent did not impair the yield as long as hydrogen sulfide was present. As little as 7.5 gr of reagent could be used to treat the described shale oil rock, i.e. about 7.5 gr (KHS basis) of reagent will treat about 1000 to 1100 gr of rock. However, the quantity necessary to coat or make contact with the rock effectively, for practical reasons, is an important consideration for assuring a thorough reaction with the rock.

When the above example runs were repeated according to the description found in connection with FIG. 1, efficient separation of dust from hydrocarbon values is obtained as long as the above prescription is followed, e.g. keeping hot the dust separation means and the separated dust. In general, higher sulfur content shale oil rock causes the reaction to become more readily exothermic with a reagent of the same sulfur composition, where for lower sulfur content shale oil rock the same reagent will not cause an exothermic reaction. For example, for the Israeli shale oil rock the empirical formula for an exothermically reacting reagent is $K_2S_{1.5}$ (mole basis mixed with ¼, on mole basis, of KHS), whereas for the Western U.S. shale oil rock an exothermically reacting reagent is $K_2S_2$ (empirical); it is mildly exothermic. A vigorous exothermic reagent for Western U.S. shale oil rock is KHS prepared from a methanolic KOH solution saturated with $H_2S$ and dried under severely reduced pressure without heating. About 75%, by weight, hydrocarbon gas was produced, with 25% liquid hydrocarbon product. The principal gas fraction was of $C_3$ and $C_5$ components (62.5% of the recovered gas).

As the sodium sulfides series are less vigorous for the Western U.S. shale oil, NaHS may be used. The last is highly preferred. For the above runs, copious amounts of dust were recovered.

Thus, the respective reagents are selected based on the above criteria and include sulfides up to $K_2S_3$ (empirical) making a subtractive allowance for the sulfur in the rock fed to the reactor 11. The above sulfides are typically in the form of their hydrates as charged to the reactor.

When employing NaHS, the technical grade flakes may be used ($NaHS.XH_2O$). Thus, as a reagent 200 cc of these loosely packed flakes have been used for 3000 cc of about 3 to 10 mesh (U.S. sieve size) shale oil rock, with highly satisfactory results and good dust separation.

In discussing the reaction in a further reactor(s) such as 17, it has been found especially advantageous to support the reagent on a suitable support. These supports must be inert under the reaction conditions in the particular reactor of the type as depicted as 17 in FIG. 1. These are used as fluidized bed (circulatory fluidized bed, partially circulating or confined fluidized bed) or fixed bed reactors.

It has been further found especially advantageous when the support is of a type commonly known as a alumina-alumina silicate of a fixed zeolite type, i.e. molecular sieve type, with ammonia exchanged for the sodium or potassium in the zeolite. Type X and Y zeolites (10 and 13) are suitable. Type Y molecular sieve zeolites are preferred; of these, the low sodium ratio sieves are especially desirable (i.e. about less than 1% $Na_2O$). The molar ratio of silica to alumina of these is about greater than 3 to 1; about 5 to 1, etc.; $Na_2O$ is about 0.2 weight percent. These are available such as from commercial sources, in forms such as powder spheres, cylindrical and other extrudates, etc., of suitable size such as ⅛ of inch extrudates or spheres. Although these have been alleged to be poisoned or destroyed by alkali metals, as worked up by the below-described procedure, these supports are especially beneficial despite the use of the herein described alkali sulfide reagents. Other zeolites are ELZ-L zeolite of the potassium type as described in U.S. Pat. No. 3,216,789, and silicalite material as described in U.S. Pat. No. 4,061,724. The last has a pore dimension of about 6 Angstrom units. Other supports are such as those described in British Pat. No. 1,178,186, i.e. the very low sodium type—less than 0.7 percent, by weight, e.g. ELZ-Ω-6, or ELZ-E-6, E-8, or E-10. Other supports are mordenites and erionites with very low sodium content obtained by ammonia exchange and of the calcined type. Of the above molecular sieves, the type Y very low sodium, e.g. 0.15, by weight, ammonia exchanged supports available under Trademark LZ-Y82 from sources such as Linde Division, Union Carbide Corporation, New York, N.Y., Mobil Oil Corporation, New York, N.Y., and other sources are preferred. In any event, the stability and durability of these molecular sieves used as supports are tested under the reaction conditions and are established by the performance in reactor(s) 17.

The preparation procedure for the supports is as follows. The low sodium ammonium exchanged zeolite extrudates, such as powders, cylinders, saddles, stars, rings, spheres, etc., of powder, or extrudates of about ⅛ to 5/32 or 3/16 inch size are treated with glycerol or like polyhydroxy alkane compounds, such as partially reacted polyhydroxy compounds including up to hexahydric alcohols, by first inpregnating these in a reactor which is kept closed. Thereafter, e.g. when using glycerol, by heating and removing decomposition products from these powders, extrudates, or balls from room temperature up to 265° to 280° and even up to 560° C., an appropriate, but unknown, reaction takes place. The thus reacted support is then screened, drained, and cooled in a closed and tightly sealed container if the temperature has been brought up to 560° C. When cold, the support is then impregnated with a reagent-catalyst of the general formula $K_2S_{1.5}$ (empirical). This reagent is obtained by dissolving 6 moles of KOH in 1½ to 2½ moles of $H_2O$; thereafter 2 to 2.5 cc of methanol or ethanol are added per mole of KOH. Then 4 moles of elemental sulfur are added to the foregoing solution which react exothermically. Thereafter, an appropriate amount of sulfur is added for adjusting the reagent to the desired sulfur level by addition of additional sulfur to form the empirical sulfide, i.e. from $K_2S_{1.1}$ to $K_2S_{2.5}$, including up to $K_2S_5$ (but the former empirical range is preferred, although as shown in Example 1, $K_2S$ is suitable).

Another reagent is prepared as follows. One mole of KOH is disssolved in 1.5 moles of water with vigorous stirring. Then 2 ml of methanol or ethanol are added immediately after KOH has dissolved. Immediately thereafter ⅔ moles of elemental sulfur are added and are allowed to react by a vigorous reaction. The reagent is adjusted to the desired empirical sulfur content by adding appropriate amounts of sulfur by further stirring, e.g. one quarter of ⅔ moles of sulfur adds 0.5 to the empirical sulfur content of $K_2S$; i.e. ¼ of ⅔ moles of dissolved sulfur gives $K_2S_{1.5}$; ½ of ⅔ moles gives $K_2S_{2.0}$, etc., including other appropriate fractions. Thus the reagent may range from $K_2S_{1.1}$ to $K_2S_{2.5}$ or even up to $K_2S_5$.

When the reagent has been thus prepared, it is vacuum evaporated to a flowing slurry. It is then poured over the cooled extrudate as described above (i.e. if the support had been heated up to 300° C. or higher), and under very low vacuum, agitated and aspirated until dry. Then the reagent is further screened when dry and introduced immediately in the reactor 17 which has been purged of air oxygen.

If the glyercol treated support is heated between 260° C. to a decomposition point (indicated by slowing down appreciably of liquid condensate), then the above described reagent slurry is added and the vessel is covered and heated up to at least 450° C., including up to 560° C.

Another method is to mix the glycerol, e.g. about 88 ml of glycerol, mixing either of the above reagents or mixtures thereof. Then the reagent-glycerol mixture is heated to drive off water and/or alcohol leaving a glycerol solution of the reagent. Temperature is brought up to 190° C. for the foregoing. The mixture is then poured over the support and with agitation brought up to at least 450° C. and even up to 560° C. Although this supported reagent is very undesirable because of its very unpleasant odor, it must be prepared under well isolated conditions.

In use for a gallon-sized first reactor 11 in conjunction with the second reactor 17, about $\frac{2}{3}$ of mole of supported reagent (empirical) is charged to the reactor 17. As an example or an embodiment, about $\frac{2}{3}$ moles of the thus supported $K_2S_{1.5}$ (empirical) catalyst is charged to the reactor 17. If the boiling point range is sought to be increased and gas production reduced for the products obtained from either reactor 11 or 17, the unsupported or supported reagent-catalyst is modified appropriately, e.g. by increasing the sulfur content in the $K_2S_x$ (empirical) compound.

Another embodiment for making a nonsupported or supported reagent capable of decreasing the molecular size of the product from reaction 11 or 17 is by adding a dried KHS powder or slurry in appropriate increments to either of the above-described reagent mixtures prepared by sulfur addition. Either unsupported or supported forms may be used. That is from $\frac{1}{3}$ to $\frac{1}{4}$ on molar basis of K, the KHS is added to the $K_2S$ (empirical) sulfide, e.g. $K_2S_{1.5}$ (empirical), and the molecular size is decreased by these additions of KHS.

The reagent activity can be maintained by hydrogen sulfide addition to the feed to reactor 11 as previously discussed.

When the process is run with the thus supported reagent in reactor(s) 17, appropriate adjustments may be made, e.g. $K_2S_{1.1}$ or $K_2S_{1.5}$ give more hydrogenation, and $K_2S_2$ gives larger molecules (also more distillate, less gases). These reactions are run in a temperature range from 113° C. to 440° C. Similar reagent adjustments may be made in other reactors, e.g. when more than one reactor 17 is used. These may also be run at different temperatures. Typically, the temperatures in each subsequent reactor are lower. If more than one reactor 17 is used, condenser 19 may be run with cooling, without cooling, or even hot, and the added reactor(s) 17 may be directly in series or interspersed with condensers such as 19 run at any of the recited conditions to either hold, lower, or increase the temperature.

The reagents used herein are the hydrosulfides and sulfides, that is, monosulfides and polysulfides of the Group IA elements of the Periodic Table other than hydrogen. Although for the stated purpose sodium, potassium, rubidium and lithium may be used, far and away the most advantageous are sodium and potassium. Of these two, for some rock potassium is preferred, while for others sodium (NaHS) is more advantageous. Although rubidium compound appears to be equally advantageous to potassium and may even be better insofar as reaction conditions are concerned, rubidium, the same as lithium, is not cost-advantageous. Sodium, such as sodium hydrosulfide, and potassium hydrosulfide are more cost-advantageous and also are preferred. Sodium hydrosulfide, as a species of the reagent, is available in bulk form and may be used as such. The reagents used are typically used as the empirical hydrates of the above-indicated hydrosulfides, monosulfides, and polysulfides when charged to the reactor 11. As previously mentioned and as it is well known, these hydrates are very complex and undergo a number of transitions during the reaction conditions, no attempt has been made to elucidate the nature of these transitions for the sulfides, hydrates, or the mixtures of each. It is sufficient to indicate, however, that the charged reagent can be a mixture of a number of hydrates or a eutectic mixture of various hydrates. As the hydrosulfides and sulfides, that is the mono and polysulfides of each alkali metal, may be employed, as well as the mixtures of each and mixtures of all of the hydrosulfides with each other, the reagent composition may be tailored to suit the particular rock composition. Similarly, during the reaction, as there is interconversion of the sulfur-containing forms of the sulfides, no attempt has been made to characterize this interconversion. It is sufficient, however, to indicate that at the reaction conditions in vessel 11 the hydrogenation takes place. More importantly, however, during the reaction conditions the shale oil rock is entirely pulverized and the pulverulent form of its rises with the hydrocarbon values. This aspect of the invention appears to be an especially advantageous discovery. In my previous application, Ser. No. 242,305, which is incorporated by reference herein, I had sought to confine the pulverulent reaction products in the reaction vessel, and while the process has been quite advantageous, this further improvement of removing the powder dust from the unreacted rock (as an exhausted shale oil rock gangue) provides considerable improvement and significant commercial attractiveness for a continuously run process according to the present invention due to its elegant simplicity in the separation of the various components during the continuous reaction.

What is claimed is:

1. In a process for recovering hydrocarbon values from shale oil rock is a western U.S. shale oil rock, the improvement comprising:

(a) reacting at a temperature up to about 560° C. in at least one reaction zone shale oil rock and a reagent of an alkali metal hydrosulfide, sulfide, polysulfide or a hydrate of same or mixtures of same, in presence of water, at a pressure from subatmospheric to 10 atm., whereby said reagent and water upon reacting with rock constituents containing hydrocarbon values shatter said rock into fine particulate gangue;

(b) separating the hydrocarbon values and a shale oil rock fine particulate gangue from the unreacted portion of said shale oil rock by removal in a flow stream of said particulates, hydrocarbon values and water in form of steam;

(c) further separating the fine particulate gangue from said hydrocarbn values while said hydrocarbon values and steam are in vaporous and/or gaseous form in at least one gas and fine particulate separation zone;

(d) recovering the thus separated fine particulate gangue, and (e) recovering the thus separated hydrocarbon values as either gaseous or liquid hydrocarbon values by cooling and/or condensation.

2. The process as defined in claim 1 wherein fine particulate-free and separated hydrocarbon values flowing in a stream from said particulate separation zone are further reacted with a reagent of an alkali hydrosulfide, sulfide, polysulfide, hydrates of same, or mixtures of the foregoing in a further reaction zone, in presence of water in said stream, and the thus treated hydrocarbon values are then recovered.

3. The process as defined in claim 2 wherein the reagent is a supported reagent.

4. The process as defined in claim 1 wherein the process is a continuous process.

5. The process as defined in claim 2 wherein the recovered hydrocarbon values are reacted in presence of water, with said reagent in a plurality of further reaction zones wherein the reagent is the reagent as defined in claim 2, wherein a reagent in each of said zones is the same or differnet reagent, and wherein said reagent is a supported or unsupported reagent.

6. The process as defined in claim 5 wherein the reagent in each reaction zone is the same or a different supported reagent, the reaction zones are serially interconnected, and the obtained gaseous hydrocarbon values, along with steam, flow from one reaction zone to another reaction zone.

7. The process as defined in claim 1 wherein the reagent is a potassium hydrosulfide hydrate.

8. The process as defined in claim 1 wherein the reagent is a sodium hydrosulfide reagent.

9. The process as defined in claim 1 wherein the shale oil rock is Western United States shale oil rock and the reagent is $K_2S_2$ as an empirical compound and hydrates thereof.

10. The process as defined in claim 1 wherein the shale oil rock is Israeli shale oil rock and the reagent is $K_2S_{1.5}$ as an empirical compound and hydrates thereof.

11. The process as defined in claim 1 wherein the constitution of reagent used is from KHS to $K_2S_3$ (empirical), and hydrates thereof and mixtures thereof, including less sulfur saturated reagents than $K_2S_3$ (empirical) which, upon sulfur addition from the sulfur in the rock, would convert, by addition of the sulfur from the rock to the reagent, the introduced amount of reagent to $K_2S_3$ (empirical) or lower.

12. The process as defined in claim 1 wherein the constitution of the reagent used is from NaHS up to $Na_2S_2$ (empirical), and hydrates thereof and mixtures thereof, including less sulfur saturated reagents than $Na_2S_2$ which, upon sulfur addition from the sulfur in the rock, would convert, by addition of the sulfur from the rock to the reagent, the introduced amount of reagent to $Na_2S_2$ or lower.

13. The process as defined in claim 1 wherein the recovered hydrocarbon values are further treated with a supported reagent in at least one reaction zone to remove sulfur, metal and/or nitrogen values therefrom, said reagent being KHS or $K_2S$.

14. The process as defined in claim 1 wherein the dust gangue and said hydrocarbon values are separated in at least one cyclone zone maintained at a temperature above which said shale oil rock hydrocarbon values substantially do not readsorb or reabsorb to or in said gangue dust.

15. The process as defined in claim 1 wherein the dust gangue and said hydrocarbon values are separated in at least one centrifuge zone maintained at a temperature at least about 10° C. above which the hydrocarbon values become significantly absorbed or adsorbed into or on said shale oil rock gangue.

16. The process as defined in claim 15 wherein said separation of gangue from said hot hydrocarbon values is in a cyclone zone followed by a centrifuge zone.

17. The process as defined in claim 1, wherein after gangue separation said hydrocarbon values are further upgraded in a plurality of reactors to obtain distillates of an API value (at 60° F.) from 26 and up by reacting in the presence of water and a reagent as defined in claim 1.

18. The process as defined in claim 1 wherein the hydrocarbon values separated from said gangue and condensed at room temperature have an API (at 60° F.) from 20 to 33 without further upgrading.

19. The process as defined in claim 1 wherein said recovered hydrocarbon values are predominantly gaseous hydrocarbon values based on the severity of an attack by said reagent on said shale oil rock and based on the degree of sulfur saturation in said reagent, wherein less sulfur saturated reagent is having a greater hydrocarbon cleavage capability and said reagent is from KHS and $K_2S_{1.1}$ to $K_2S_{1.5}$.

20. The process as defined in claim 1 wherein said recovered hydrocarbon values are predominantly liquid distillates at room temperature.

21. In a process for recovering hydrocarbon vaues from shale oil rock, the improvement comprising:

(a) reacting at a temperature up to about 560° C. in at least one reaction zone shale oil rock and a reagent of an alkali metal hydrosulfide, sulfide, polysulfide or a hydrate of same or mixtures of same, in presence of water, water and hydrogen sulfide, water and sulfur, or water, hydrogen sulfide and sulfur, at a pressure from subatmospheric to 10 atm., whereby said reagent and water upon reacting with rock constituents containing hydrocarbon values shatter said rock into fine particulate gangue;

(b) separating the hydrocarbon values and a shale oil rock fine particulate gangue from the unreacted portion of said shale oil rock by removal in a flow stream of said particulates, hydrocarbon values and water in form of steam;

(c) further separating the fine particulate gangue from said hydrocarbon values while said hydrocarbon values and steam are in gaseous form in at least one gas and fine particulate separation zone;

(d) recovering the thus separated fine particulate gangue;

(e) recovering the thus separated hydrocarbon values as either gaseous or liquid hydrocarbon values by cooling and/or condensation, and (f) reacting in a further reaction zone said hydrocarbon values in the presence of a supported reagent, wherein the reagent is of an alkali metal hydrosulfide, sulfide, polysulfide or a hydrate of same or mixtures of same, and wherein the support is substantially inert under the reaction conditions.

22. The process as defined in claim 21 wherein the hydrocarbon values treated in the second reactor are with a reagent within the series of $K_2S$ to $K_2S_5$, based on sulfur saturation, and wherein said reagent is deposited on said support which has been treated with glycerol or said reagent is deposited on said support as a reagent-glycerol mixture and the support is thereafter heated up to 560° C. to drive off the volatiles.

23. The process as defined in claim 21 wherein the support is a silicate-alumina with the silica to alumina ratio of about 3 to 1 and greater and with low sodium content of about less than 1.0% $Na_2O$.

24. The process as defined in claim 22 wherein the supported reagent in said further reaction zone is KHS, $K_2S_{1.1}$ to $K_2S_2$, KHS in admixture with $K_2S_{1.1}$ to $K_2S_2$ and the reaction is run at a temperature 440° C. and lower.

25. The process as defined in claim 22 wherein the supported reagent is $K_2S_{1.1}$ to $K_2S_{2.5}$.

26. The process as defined in claim 1 and wherein in step (a) the reaction is also in presence of hydrogen sulfide or sulfur added to said reaction zone in step (a).

27. The process as defined in claim 2 and wherein said stream of fine particulate-free and separated hydrocarbon values are cooled and then further reacted in said further reaction zone.

* * * * *